US011403986B2

(12) United States Patent
Kang

(10) Patent No.: US 11,403,986 B2
(45) **Date of Patent: *Aug. 2, 2022**

(54) PIXEL SIGNAL CONVERSION METHOD AND DEVICE, AND COMPUTER DEVICE

(71) Applicant: HKC Corporation Limited, Guangdong (CN)

(72) Inventor: Chih Tsung Kang, Guangdong (CN)

(73) Assignee: HKC CORPORATION LIMITED, Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/043,412

(22) PCT Filed: Nov. 22, 2018

(86) PCT No.: PCT/CN2018/116961

§ 371 (c)(1),
(2) Date: Sep. 29, 2020

(87) PCT Pub. No.: WO2020/093461

PCT Pub. Date: May 14, 2020

(65) Prior Publication Data

US 2021/0110754 A1 Apr. 15, 2021

(30) Foreign Application Priority Data

Nov. 7, 2018 (CN) ..... 201811320176.X

(51) Int. Cl.
*G09G 3/20* (2006.01)

(52) U.S. Cl.
CPC ... *G09G 3/2003* (2013.01); *G09G 2300/0452* (2013.01); *G09G 2340/06* (2013.01)

(58) Field of Classification Search
CPC ..... G09G 3/2003; G09G 2300/0452; G09G 2340/06
See application file for complete search history.

(56) References Cited

U.S. PATENT DOCUMENTS 6,072,902 A 6/2000 Myers
6,346,969 B1 2/2002 Kwon
(Continued)

FOREIGN PATENT DOCUMENTS

CN 1637823 A 7/2005
CN 1949885 A 4/2007
(Continued)

OTHER PUBLICATIONS

International Search Report for Application No. PCT/CN2018/116961 dated Apr. 30, 2019, 3 pages.
(Continued)

*Primary Examiner* — Patrick N Edouard
*Assistant Examiner* — Eboni N Giles

(57) ABSTRACT

A pixel signal conversion method and device, and a computer device, said method comprising: according to a first initial sub-pixel signal, a second initial sub-pixel signal and a third initial sub-pixel signal in the pixel signals, obtaining first stimulus value signals, second stimulus value signals and third stimulus value signals correspondingly. When the converted pixel signals are applied to a mixed color display composed of four sub-pixels of W, R, G, and B, the display effect is closer to the actual performance of the original R, G, and B mixed color, and the color cast defect of the large viewing angle is reduced.

10 Claims, 7 Drawing Sheets

(56) References Cited

U.S. PATENT DOCUMENTS

| | | | | |
|---|---|---|---|---|
| 7,301,516 | B2 | 11/2007 | Baek | |
| 8,169,389 | B2 * | 5/2012 | Cok | H04N 9/67 345/83 |
| 9,245,472 | B2 | 1/2016 | Jang | |
| 9,478,156 | B2 | 10/2016 | Jeong et al. | |
| 2016/0253942 | A1 * | 9/2016 | Tseng | G09G 3/2003 345/601 |
| 2020/0143732 | A1 * | 5/2020 | Xi | G09G 3/2003 |
| 2021/0256922 | A1 * | 8/2021 | Kang | G09G 3/3607 |

FOREIGN PATENT DOCUMENTS

| | | | |
|---|---|---|---|
| CN | 101149900 | A | 3/2008 |
| CN | 101625476 | A | 1/2010 |
| CN | 102394040 | A | 3/2012 |
| CN | 103295559 | B | 9/2013 |
| CN | 103886829 | A | 6/2014 |
| CN | 103915078 | A | 7/2014 |
| CN | 103928011 | A | 7/2014 |
| CN | 104077997 | A | 10/2014 |
| CN | 104471922 | A | 3/2015 |
| CN | 104981861 | A | 10/2015 |
| CN | 105472364 | A | 4/2016 |
| JP | 5122268 | B2 | 1/2013 |
| KR | 20180063611 | A | 6/2018 |

OTHER PUBLICATIONS

Chinese Office Action for Application No. 201811320176.X dated Nov. 5, 2019, 5 pages.
Chinese Office Action for Application No. 201811320170.2 dated Nov. 5, 2019, 6 pages.
Chinese Office Action for Application No. 201811320177.4 dated Nov. 27, 2019, 7 pages.

* cited by examiner

PIXEL SIGNAL CONVERSION METHOD AND DEVICE, AND COMPUTER DEVICE

CROSS REFERENCE TO RELATED APPLICATIONS

This application is a U.S. National Stage application of, and claims priority to, PCT/CN2018/116961, filed Nov. 22, 2018, which further claims priority to Chinese Patent Application No. 201811320176.X, filed Nov. 7, 2018, the entire contents of which are incorporated herein in their entirety.

TECHNICAL FIELD

The present disclosure relates to a pixel signal conversion method and device and a computer apparatus.

BACKGROUND

In a conventional liquid crystal display, a required display color is generally generated by using a hybrid color of a three-color light source that is generated by using three subpixels of red (R), green (G), and blue (B). Three subpixels R, G, and B absorb a photoresist, so that a light source of three colors R, G, and B absorbs an optical band of a non-R-G-subpixel B unit. In this way, the three subpixels R, G, and B generate a corresponding light source of three colors R, G, and B.

Because of a resolution increase of a liquid crystal display, a subpixel increase, and a decrease of a pixel aperture ratio corresponding to a subpixel, a penetration rate of a high-resolution display loses and optical efficiency decreases. Therefore, to balance a high resolution, a penetration rate, optical efficiency, and backlight architectural costs of a liquid crystal display, a hybrid-color display formed by four-color subpixels white (W), R, G, and B appears. The white subpixel has no photoresist absorbing material absorbing visible optical energy, so that a penetration rate and optical efficiency of the display can be improved.

However, because the white subpixel W has a high penetration rate, light leakage of a large view angle causes color cast, and consequently picture quality is affected when an image is watched at a large view angle. In addition, because full-wavelength penetration rate properties of a visible light of a front view angle and a large view angle of some types of liquid crystal displays are different, an optical property of watching the liquid crystal displays at a large view angle cannot maintain a same correct color of watching the liquid crystal displays at a front view angle.

Therefore, the inventor finds that when a subpixel signal of three colors R, G, and B is used for driving on a hybrid-color display formed by four-color subpixels W, R, G, and B, there is a defect of color cast of a large viewing angle.

SUMMARY

According to various embodiments of the present disclosure, a pixel signal conversion method and device and a computer apparatus are provided.

A pixel signal conversion method comprises the following steps:

obtaining a pixel signal, wherein the pixel signal comprises an initial subpixel R signal, an initial subpixel G signal, and an initial subpixel B signal, and the pixel signal is used to correspondingly drive a subpixel R, a subpixel G, and a subpixel B in a particular pixel unit;

obtaining first stimulus value signals of the initial subpixel R signal according to the initial subpixel R signal, obtaining second stimulus value signals of the initial subpixel G signal according to the initial subpixel G signal, and obtaining third stimulus value signals of the initial subpixel B signal according to the initial subpixel B signal;

obtaining a subpixel W signal according to a minimum value in a stimulus value signal set, wherein the stimulus value signal set comprises a first stimulus value signal, a second stimulus value signal, and a third stimulus value signal;

obtaining a converted subpixel R signal according to a difference between any first stimulus value signal and the minimum value, obtaining a converted subpixel G signal according to a difference between any second stimulus value signal and the minimum value, and obtaining a converted subpixel B signal according to a difference between any third stimulus value signal and the minimum value; and using the converted subpixel R signal, the converted subpixel G signal, the converted subpixel B signal, and the subpixel W signal as converted pixel signals, wherein the converted pixel signals are used to correspondingly drive the subpixel R, the subpixel G, the subpixel B, and a subpixel W in the particular pixel unit.

In an embodiment, before a process of obtaining a subpixel W signal according to a minimum value in a stimulus value signal set, the method further comprises the following step:

separately performing gain processing on the first stimulus value signal, the second stimulus value signal, and the third stimulus value signal according to a preset gain value.

In an embodiment, a process of obtaining a subpixel W signal according to a minimum value in a stimulus value signal set comprises the following step:

according to a relationship between the subpixel W signal and any fourth stimulus value signal of the subpixel W signal, assigning the minimum value to the any fourth stimulus value signal, to obtain the subpixel W signal.

In an embodiment, the fourth stimulus value signal is a stimulus value signal WX, a stimulus value signal WY, or a stimulus value signal WZ; and the any fourth stimulus value signal is the stimulus value signal WY.

In an embodiment, the first stimulus value signal is a stimulus value signal RX, a stimulus value signal RY, or a stimulus value signal RZ; and the second stimulus value signal is a stimulus value signal GX, a stimulus value signal GY, or a stimulus value signal GZ; and the third stimulus value signal is a stimulus value signal BX, a stimulus value signal BY, or a stimulus value signal BZ.

In an embodiment, the stimulus value signal set comprises the stimulus value signal RY, the stimulus value signal GY, and the stimulus value signal BY.

In an embodiment, the stimulus value signal set comprises the stimulus value signal RX, the stimulus value signal GY, and the stimulus value signal BZ.

In an embodiment, a process of obtaining first stimulus value signals of the initial subpixel R signal according to the initial subpixel R signal is represented by the following formula:

$$\begin{cases} RX = (R/T)^{\wedge\gamma RX} \\ RY = (R/T)^{\wedge\gamma RY} \\ RZ = (R/T)^{\wedge\gamma RZ} \end{cases};$$

a process of obtaining second stimulus value signals of the initial subpixel G signal according to the initial subpixel G signal is represented by the following formula:

$$\begin{cases} GX = (G/T)^{\wedge\gamma GX} \\ GY = (G/T)^{\wedge\gamma GY} \\ GZ = (G/T)^{\wedge\gamma GZ} \end{cases};$$

and a process of obtaining third stimulus value signals of the initial subpixel B signal according to the initial subpixel B signal is represented by the following formula:

$$\begin{cases} BX = (B/T)^{\wedge\gamma BX} \\ BY = (B/T)^{\wedge\gamma BY} \\ BZ = (B/T)^{\wedge\gamma BZ} \end{cases},$$

wherein

RX is the stimulus value signal RX, RY is the stimulus value signal RY, RZ is the stimulus value signal RZ, and R is the initial subpixel R signal; GX is the stimulus value signal GX, GY is the stimulus value signal GY, GZ is the stimulus value signal GZ, and G is the initial subpixel G signal; BX is the stimulus value signal BX, BY is the stimulus value signal BY, BZ is the stimulus value signal BZ, and B is the initial subpixel B signal; and T is a maximum pixel signal value; and γRX, γRY, and γRZ are all stimulus value power functions of the initial subpixel R signal; γGX, γGY, and γGZ are all stimulus value power functions of the initial subpixel G signal; and γBX, γBY, and γBZ are all stimulus value power functions of the initial subpixel B signal.

A pixel signal conversion device comprises:

a pixel signal obtaining module, configured to obtain a pixel signal, wherein the pixel signal comprises an initial subpixel R signal, an initial subpixel G signal, and an initial subpixel B signal, and the pixel signal is used to correspondingly drive a subpixel R, a subpixel G, and a subpixel B in a particular pixel unit;

a signal processing module, configured to: obtain first stimulus value signals of the initial subpixel R signal according to the initial subpixel R signal, obtain second stimulus value signals of the initial subpixel G signal according to the initial subpixel G signal, and obtain third stimulus value signals of the initial subpixel B signal according to the initial subpixel B signal;

a subpixel W obtaining module, configured to obtain a subpixel W signal according to a minimum value in a stimulus value signal set, wherein the stimulus value signal set comprises a first stimulus value signal, a second stimulus value signal, and a third stimulus value signal;

a converted subpixel obtaining module, configured to: obtain a converted subpixel R signal according to a difference between any first stimulus value signal and the minimum value, obtain a converted subpixel G signal according to a difference between any second stimulus value signal and the minimum value, and obtain a converted subpixel B signal according to a difference between any third stimulus value signal and the minimum value; and a signal conversion module, configured to use the converted subpixel R signal, the converted subpixel G signal, the converted subpixel B signal, and the subpixel W signal as converted pixel signals, wherein the converted pixel signals are used to correspondingly drive the subpixel R, the subpixel G, the subpixel B, and a subpixel W in the particular pixel unit.

In an embodiment, before a process of obtaining a subpixel W signal according to a minimum value in a stimulus value signal set, the method further comprises the following step:

separately performing gain processing on the first stimulus value signal, the second stimulus value signal, and the third stimulus value signal according to a preset gain value.

In an embodiment, a process of obtaining a subpixel W signal according to a minimum value in a stimulus value signal set comprises the following step:

according to a relationship between the subpixel W signal and any fourth stimulus value signal of the subpixel W signal, assigning the minimum value to the any fourth stimulus value signal, to obtain the subpixel W signal.

In an embodiment, the fourth stimulus value signal is a stimulus value signal WX, a stimulus value signal WY, or a stimulus value signal WZ; and the any fourth stimulus value signal is the stimulus value signal WY.

In an embodiment, the first stimulus value signal is a stimulus value signal RX, a stimulus value signal RY, or a stimulus value signal RZ; and the second stimulus value signal is a stimulus value signal GX, a stimulus value signal GY, or a stimulus value signal GZ; and the third stimulus value signal is a stimulus value signal BX, a stimulus value signal BY, or a stimulus value signal BZ.

In an embodiment, the stimulus value signal set comprises the stimulus value signal RY, the stimulus value signal GY, and the stimulus value signal BY.

In an embodiment, the stimulus value signal set comprises the stimulus value signal RX, the stimulus value signal GY, and the stimulus value signal BZ.

In an embodiment, a process of obtaining first stimulus value signals of the initial subpixel R signal according to the initial subpixel R signal is represented by the following formula:

$$\begin{cases} RX = (R/T)^{\wedge\gamma RX} \\ RY = (R/T)^{\wedge\gamma RY} \\ RZ = (R/T)^{\wedge\gamma RZ} \end{cases};$$

a process of obtaining second stimulus value signals of the initial subpixel G signal according to the initial subpixel G signal is represented by the following formula:

$$\begin{cases} GX = (G/T)^{\wedge\gamma GX} \\ GY = (G/T)^{\wedge\gamma GY} \\ GZ = (G/T)^{\wedge\gamma GZ} \end{cases};$$

and a process of obtaining third stimulus value signals of the initial subpixel B signal according to the initial subpixel B signal is represented by the following formula:

$$\begin{cases} BX = (B/T)^{\wedge\gamma BX} \\ BY = (B/T)^{\wedge\gamma BY} \\ BZ = (B/T)^{\wedge\gamma BZ} \end{cases},$$

wherein

RX is the stimulus value signal RX, RY is the stimulus value signal RY, RZ is the stimulus value signal RZ, and R is the initial subpixel R signal; GX is the stimulus value signal GX, GY is the stimulus value signal GY, GZ is the stimulus value signal GZ, and G is the initial subpixel G signal; BX is the stimulus value signal BX, BY is the stimulus value signal BY, BZ is the stimulus value signal BZ, and B is the initial subpixel B signal; and T is a maximum pixel signal value; and γRX, γRY, and γRZ are all stimulus value power functions of the initial subpixel R signal; γGX, γGY, and γGZ are all stimulus value power functions of the initial subpixel G signal; and γBX, γBY, and γBZ are all stimulus value power functions of the initial subpixel B signal.

A computer apparatus, comprising a memory and a processor, the memory stores a computer program, and when executing the computer program, the processor performs the following steps:

obtaining a pixel signal, wherein the pixel signal comprises an initial subpixel R signal, an initial subpixel G signal, and an initial subpixel B signal, and the pixel signal is used to correspondingly drive a subpixel R, a subpixel G, and a subpixel B in a particular pixel unit;

obtaining first stimulus value signals of the initial subpixel R signal according to the initial subpixel R signal, obtaining second stimulus value signals of the initial subpixel G signal according to the initial subpixel G signal, and obtaining third stimulus value signals of the initial subpixel B signal according to the initial subpixel B signal;

obtaining a subpixel W signal according to a minimum value in a stimulus value signal set, wherein the stimulus value signal set comprises a first stimulus value signal, a second stimulus value signal, and a third stimulus value signal;

obtaining a converted subpixel R signal according to a difference between any first stimulus value signal and the minimum value, obtaining a converted subpixel G signal according to a difference between any second stimulus value signal and the minimum value, and obtaining a converted subpixel B signal according to a difference between any third stimulus value signal and the minimum value; and using the converted subpixel R signal, the converted subpixel G signal, the converted subpixel B signal, and the subpixel W signal as converted pixel signals, wherein the converted pixel signals are used to correspondingly drive the subpixel R, the subpixel G, the subpixel B, and a subpixel W in the particular pixel unit.

In an embodiment, before a process of obtaining a subpixel W signal according to a minimum value in a stimulus value signal set, the method further comprises the following step:

separately performing gain processing on the first stimulus value signal, the second stimulus value signal, and the third stimulus value signal according to a preset gain value.

In an embodiment, a process of obtaining a subpixel W signal according to a minimum value in a stimulus value signal set comprises the following step:

according to a relationship between the subpixel W signal and any fourth stimulus value signal of the subpixel W signal, assigning the minimum value to the any fourth stimulus value signal, to obtain the subpixel W signal.

In an embodiment, the fourth stimulus value signal is a stimulus value signal WX, a stimulus value signal WY, or a stimulus value signal WZ; and the any fourth stimulus value signal is the stimulus value signal WY.

Details of one or more embodiments of the present disclosure are provided in the following accompanying drawings and descriptions. Other features and advantages of the present disclosure become apparent in the specification, the accompanying drawings, and the claims.

BRIEF DESCRIPTION OF THE DRAWINGS

To describe more clearly the technical solutions in the embodiments of the present disclosure, the following briefly describes the accompanying drawings that need to be used in the embodiments. Obviously, the accompanying drawings in the following description are only some embodiments of the present disclosure, and a person of ordinary skill in the art can further obtain other accompanying drawings according to the accompanying drawings without creative efforts.

DETAILED DESCRIPTION OF THE EMBODIMENTS

To make the technical solutions and advantages of the present disclosure clearer, the following describes the present disclosure in further detail with reference to the accompanying drawings and embodiments. It should be understood that the specific embodiments described herein are intended only to explain the present disclosure and are not intended to limit the present disclosure.

The present disclosure provides a pixel signal conversion method.

Figure 1:
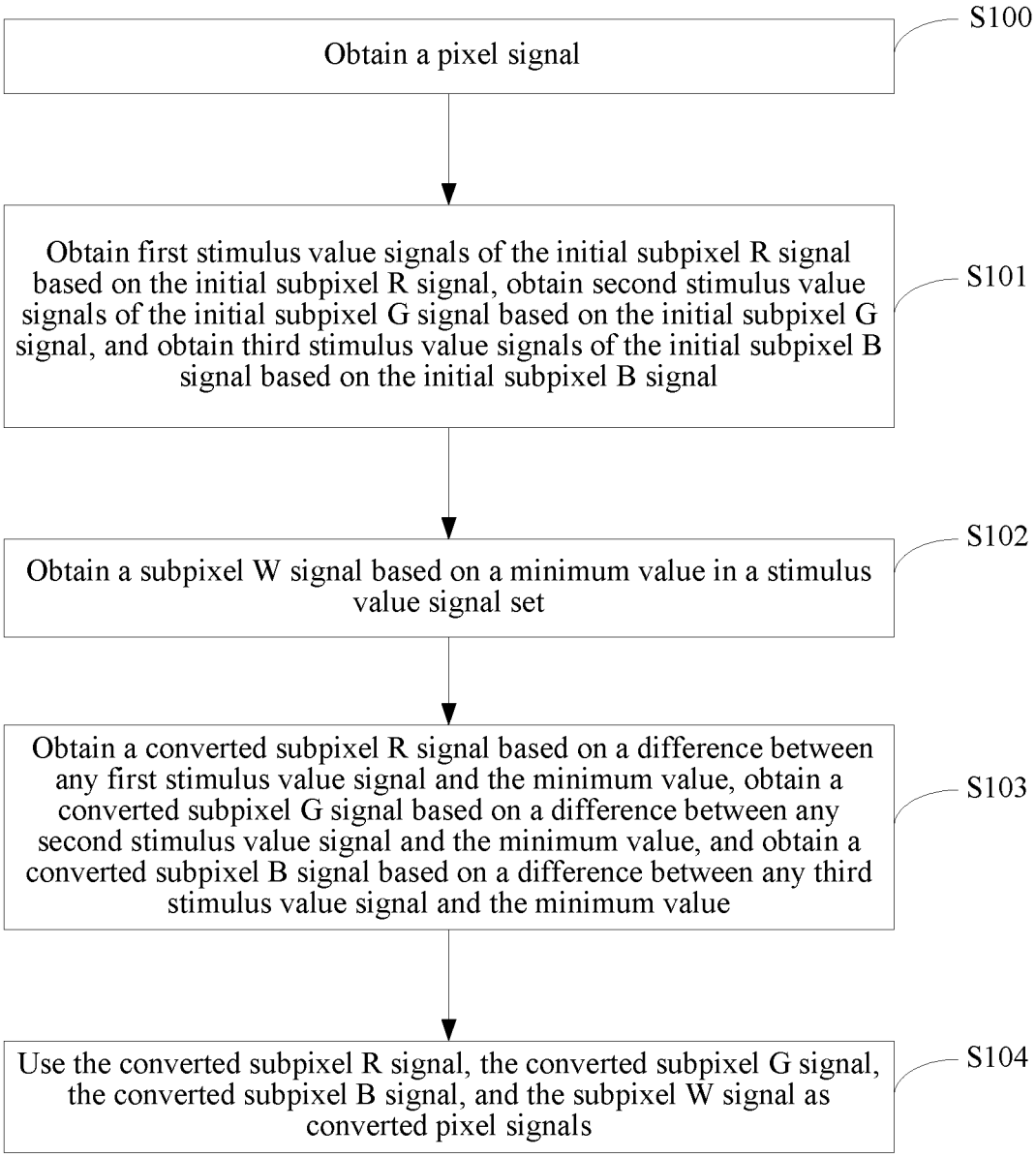
FIG. 1 is a schematic flowchart of a pixel signal conversion method according to one or more embodiments.

FIG. 1 is a schematic flowchart of a pixel signal conversion method according to one or more embodiments. As shown in FIG. 1, the pixel signal conversion method includes steps S100 to S104:

S100, a pixel signal is obtained. The pixel signal includes an initial subpixel R signal, an initial subpixel G signal, and an initial subpixel B signal. In an embodiment, the pixel signal is used to correspondingly drive an subpixel R, a subpixel G, and a subpixel B in a particular pixel unit.

Figure 2:
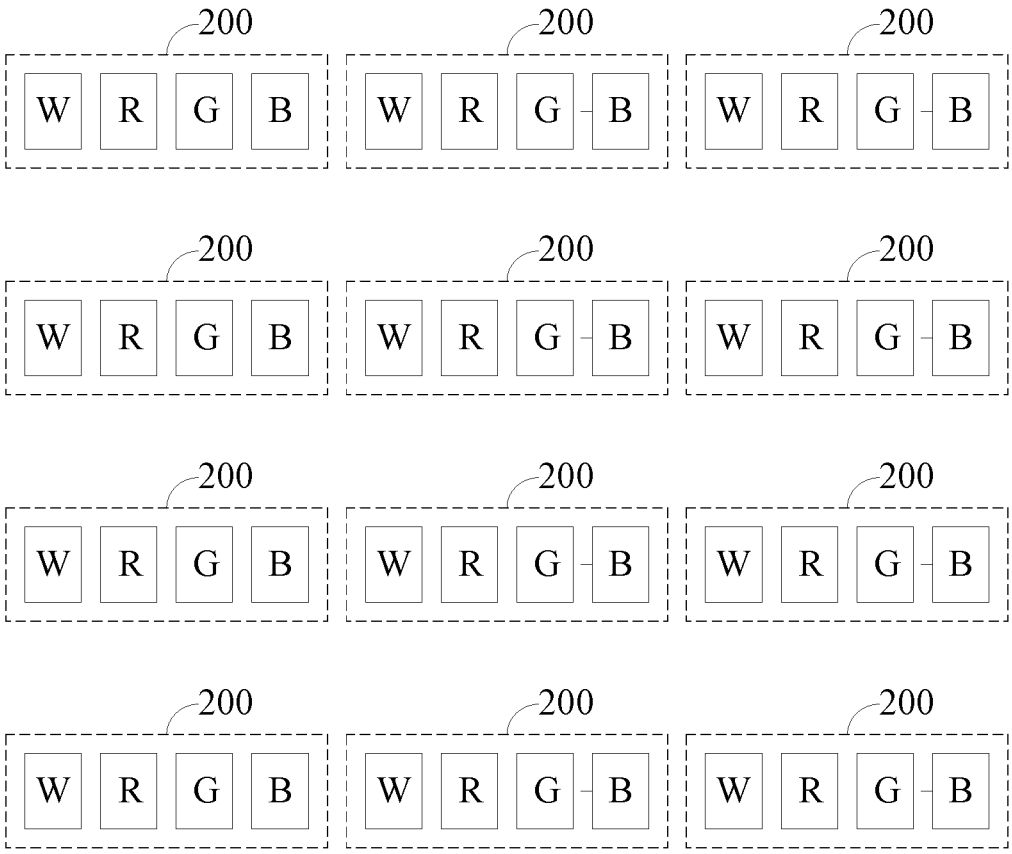
FIG. 2 is a schematic diagram of a four-color display array.

In an embodiment, FIG. 2 is a schematic diagram of a four-color display array. As shown in FIG. 2, the four-color display array includes a plurality of four-color pixel units 200 arranged in rows and columns, and each four-color pixel unit 200 includes four subpixels, that is, a subpixel R, a subpixel G, a subpixel B, and a subpixel W (white). A conventional three-color display array includes a plurality of three-color pixel units arranged in rows and columns, and each three-color pixel unit includes only three subpixels, that is, the subpixel R, the subpixel G, and the subpixel B. In an embodiment, the particular pixel unit may be any pixel unit in the four-color display array shown in FIG. 2. The pixel signal before conversion obtained in step S100 is used to correspondingly drive the subpixel R, the subpixel G, and the subpixel B in the particular pixel unit, to change brightness of the correspondingly driven subpixel. Specifically, the initial subpixel R signal drives the subpixel R, the initial subpixel G signal drives the subpixel G, and the initial subpixel B signal drives the subpixel B.

S101, first stimulus value signals of the initial subpixel R signal are obtained according to the initial subpixel R signal, obtain second stimulus value signals of the initial subpixel G signal according to the initial subpixel G signal, and third stimulus value signals of the initial subpixel B signal are obtained according to the initial subpixel B signal.

The pixel signal includes three subpixel signals, that is, the initial subpixel R signal, the initial subpixel G signal, and the initial subpixel B signal. In an embodiment, each subpixel signal corresponds to a stimulus value signal according to optical brightness. It should be noted that a subpixel signal may correspond to a plurality of stimulus value signals. Specifically, a stimulus value signal corresponding to the initial subpixel R signal is the first stimulus value signal, a stimulus value signal corresponding to the initial subpixel G signal is the second stimulus value signal, and a stimulus value signal corresponding to the initial subpixel B signal is the third stimulus value signal.

In an embodiment, the first stimulus value signal is a stimulus value signal RX, a stimulus value signal RY, or a stimulus value signal RZ;

the second stimulus value signal is a stimulus value signal GX, a stimulus value signal GY, or a stimulus value signal GZ; and the third stimulus value signal is a stimulus value signal BX, a stimulus value signal BY, or a stimulus value signal BZ.

Correspondingly, a process of obtaining first stimulus value signals of the initial subpixel R signal according to the initial subpixel R signal is represented by the following formula:

$$\begin{cases} RX = (R/T)^{\wedge\gamma RX} \\ RY = (R/T)^{\wedge\gamma RY} \\ RZ = (R/T)^{\wedge\gamma RZ} \end{cases};$$

a process of obtaining second stimulus value signals of the initial subpixel G signal according to the initial subpixel G signal is represented by the following formula:

$$\begin{cases} GX = (G/T)^{\wedge\gamma GX} \\ GY = (G/T)^{\wedge\gamma GY} \\ GZ = (G/T)^{\wedge\gamma GZ} \end{cases};$$

and a process of obtaining third stimulus value signals of the initial subpixel B signal according to the initial subpixel B signal is represented by the following formula:

$$\begin{cases} BX = (B/T)^{\wedge\gamma BX} \\ BY = (B/T)^{\wedge\gamma BY} \\ BZ = (B/T)^{\wedge\gamma BZ} \end{cases}.$$

In an embodiment, RX is the stimulus value signal RX, RY is the stimulus value signal RY, RZ is the stimulus value signal RZ, and R is the initial subpixel R signal. GX is the stimulus value signal GX, GY is the stimulus value signal GY, GZ is the stimulus value signal GZ, and G is the initial subpixel G signal. BX is the stimulus value signal BX, BY is the stimulus value signal BY, BZ is the stimulus value signal BZ. B is the initial subpixel B signal; and T is a maximum pixel signal value.

In an embodiment, the maximum pixel signal value depends on a type of a displayed image. For example, when an 8-bit greyscale digital image is displayed, the maximum pixel signal value is $2^8-1=255$.

In an embodiment, γRX, γRY, and γRZ are all stimulus value power functions of the initial subpixel R signal; γGX, γGY, and γGZ are all stimulus value power functions of the initial subpixel G signal; and γBX, γBY, and γBZ are all stimulus value power functions of the initial subpixel B signal.

S102, a subpixel W signal is obtained according to a minimum value in a stimulus value signal set, in an embodiment, the stimulus value signal set includes a first stimulus value signal, a second stimulus value signal, and a third stimulus value signal.

Figure 3:
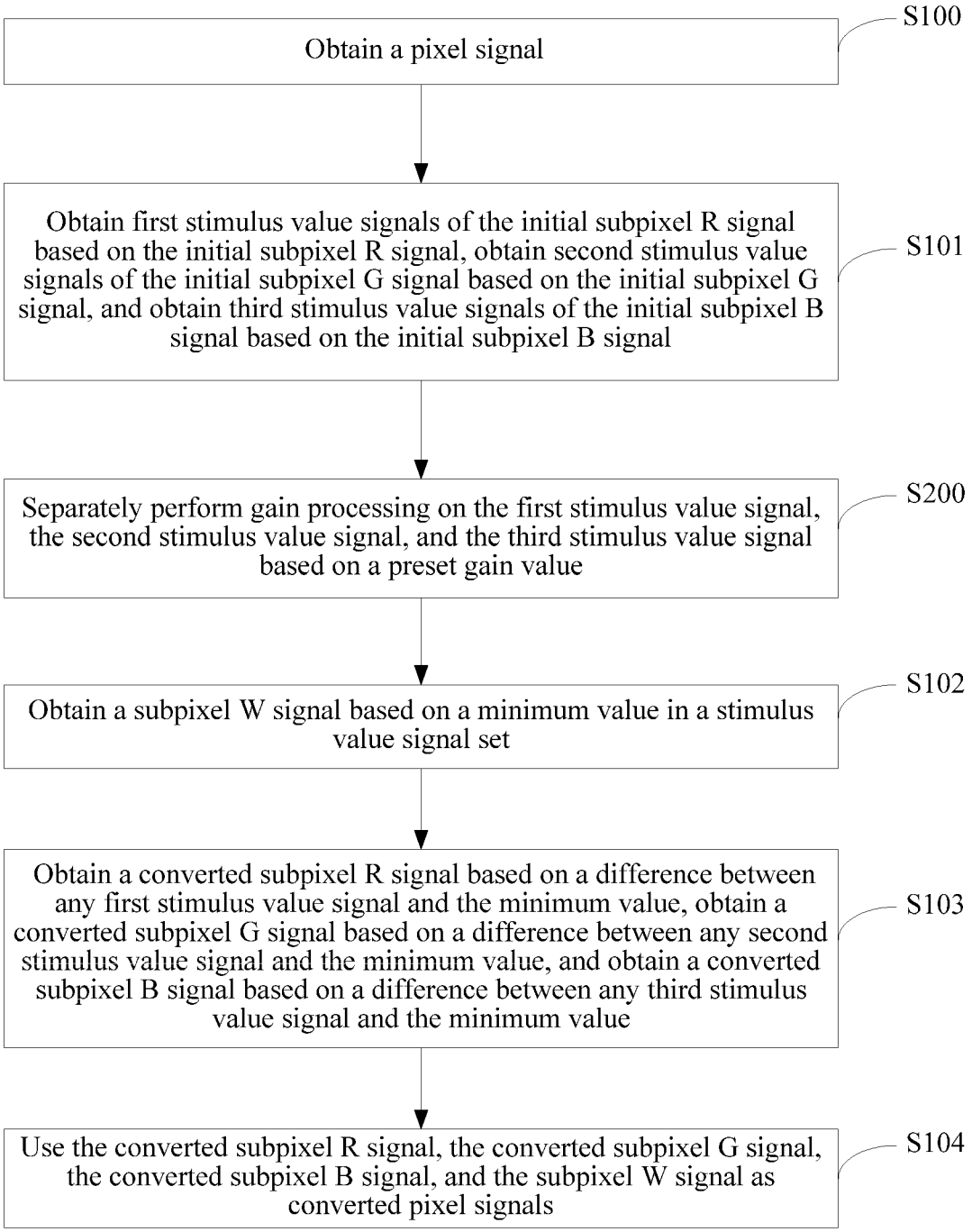
FIG. 3 is a flowchart of another pixel signal conversion method according to one or more embodiments.

In an embodiment, FIG. 3 is a flowchart of another pixel signal conversion method according to one or more embodiments. As shown in FIG. 3, before a process of obtaining a subpixel W signal according to a minimum value in a stimulus value signal set in step S102, the method further includes step S200:

S200: gain processing is performed on the first stimulus value signal, the second stimulus value signal, and the third stimulus value signal, respectively according to a preset gain value.

In an embodiment, as described above, the first stimulus value signal includes RX, RY, and RZ. Gain processing is performed on the first stimulus value signal. For example, the preset gain value is 2. The first stimulus value signal on which gain processing has been performed is two times of the original stimulus value signal, that is, 2RX, 2RY, and 2RZ. Similarly, the second stimulus value signal on which two-times gain processing has been performed is 2GX, 2GY, and 2GZ. The third stimulus value signal on which two-times gain processing has been performed is 2BX, 2BY, and 2BZ. In an embodiment, it should be noted that the preset gain value includes, but is not limited to, 2.

In an embodiment, the stimulus value signal set includes the stimulus value signal RY, the stimulus value signal GY, and the stimulus value signal BY.

Figure 4:
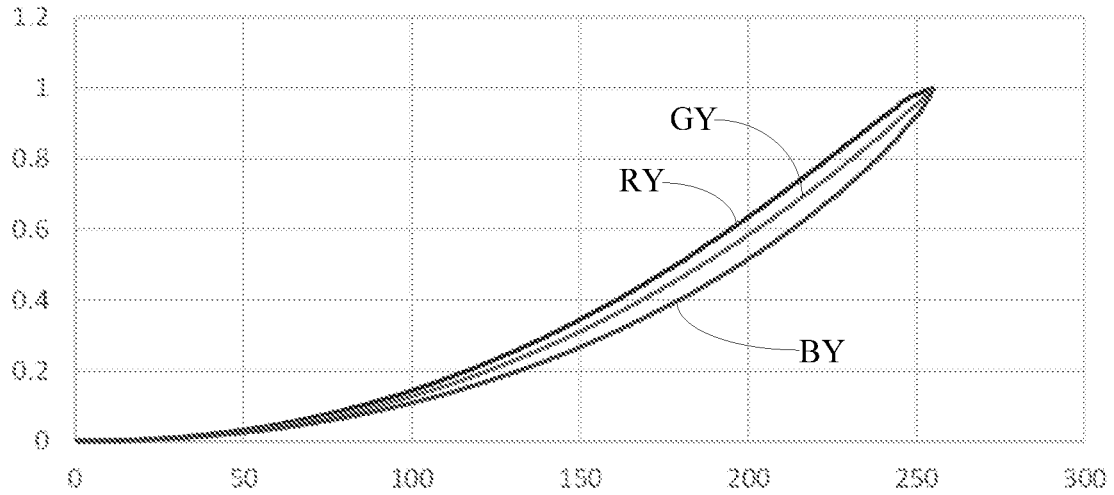
FIG. 4 is a schematic diagram of a curve of a stimulus value signal set according to one or more embodiments.

Assuming that the stimulus value signal set is U1, U1=(RY, GY, BY). FIG. 4 is a schematic diagram of a curve of a stimulus value signal set according to one or more embodiments. As shown in FIG. 4, the x-axis direction shows a subpixel signal, and the y-axis direction shows a stimulus value signal. Changing of the stimulus value signal in the stimulus value signal set along with the subpixel signal is represented in FIG. 3. In an embodiment, the minimum value in the stimulus value signal set Min1=min(RY, GY, BY). It should be noted that after two-times gain processing, U1=(2RY, 2GY, 2BY).

In an embodiment, the stimulus value signal set includes the stimulus value signal RX, the stimulus value signal GY, and the stimulus value signal BZ.

Figure 5:
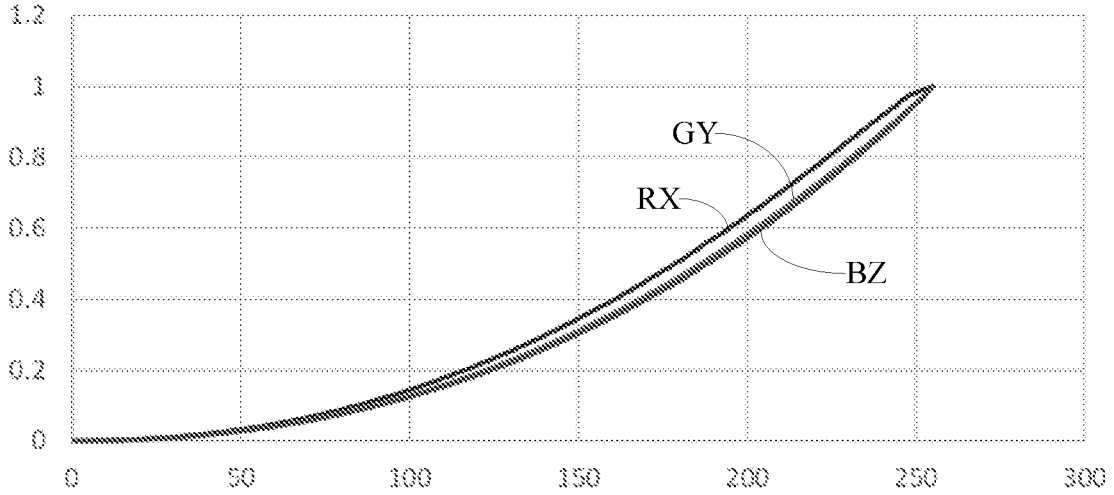
FIG. 5 is a schematic diagram of a curve of another stimulus value signal set according to one or more embodiments.

It is assumed that the stimulus value signal set is U2, U2=(RX, GY, BZ). It should be noted that after two-times gain processing, U2=(2RX, 2GY, 2BZ). FIG. 5 is a schematic diagram of a curve of another stimulus value signal set according to one or more embodiments. As shown in FIG. 5, the x-axis direction shows a subpixel signal, and the y-axis direction shows a stimulus value signal. Changing of the stimulus value signal in the stimulus value signal set along with the subpixel signal is represented in FIG. 4. In an embodiment, as shown in FIG. 4, in comparison between the stimulus value signal set U2 and the stimulus value signal set U1, proportions and weights of stimulus value signals in the stimulus value signal set U2 are closer, so that a subsequently converted subpixel signal may be closer to actual representation of original R, G, B mixed-colors.

In an embodiment, the minimum value in the stimulus value signal set Min2=min(RX, GY, BZ).

Figure 6:
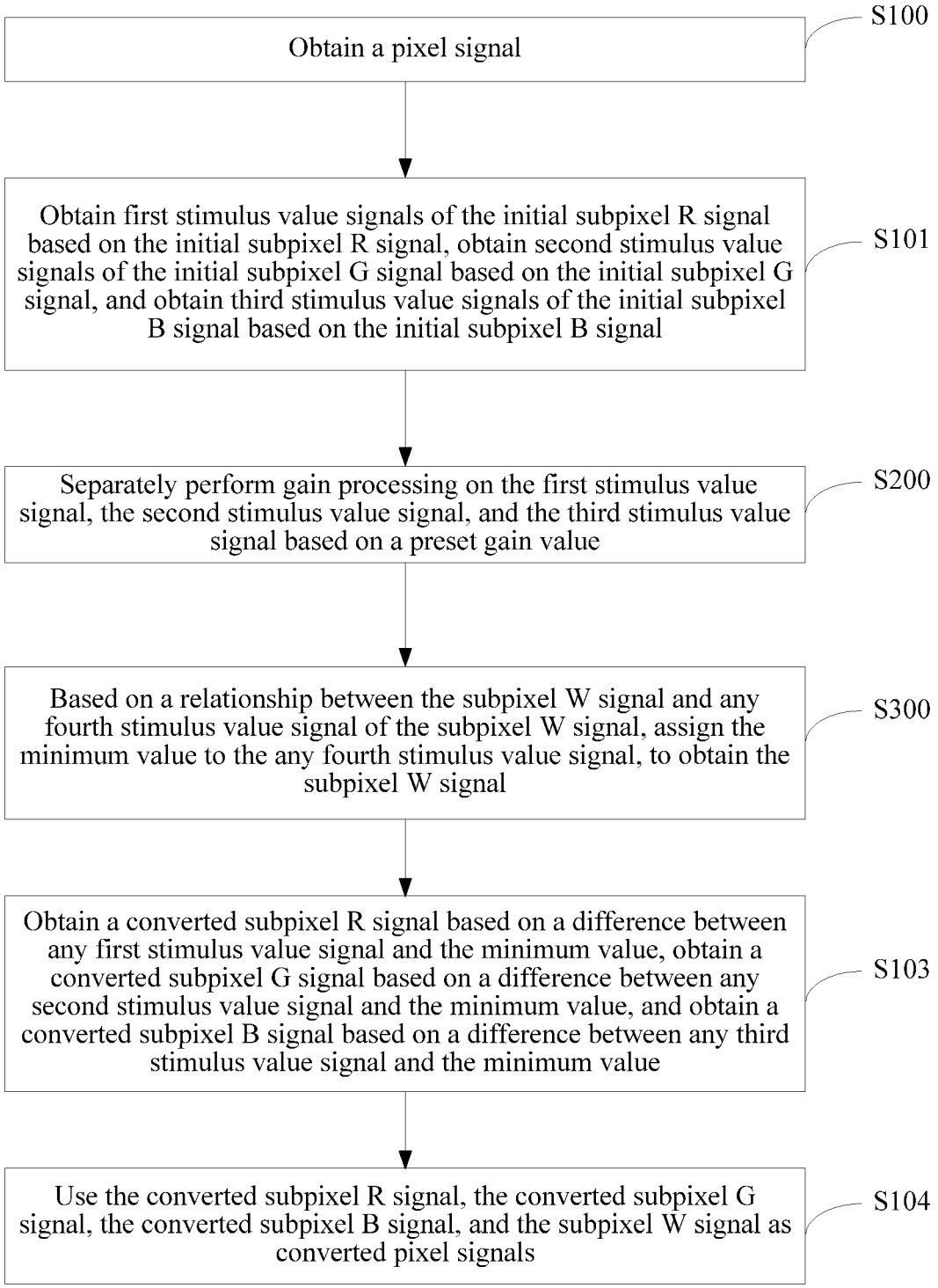
FIG. 6 is a flowchart of another pixel signal conversion method according to one or more embodiments.

FIG. 6 is a flowchart of another pixel signal conversion method according to one or more embodiments. As shown in FIG. 6, a process of obtaining a subpixel W signal according to a minimum value in a stimulus value signal set in step S102 includes step S300:

S300, according to a relationship between the subpixel W signal and any fourth stimulus value signal of the subpixel W signal, the minimum value is assigned to the any fourth stimulus value signal, to obtain the subpixel W signal.

In an embodiment, correspondingly, the subpixel W signal also includes a stimulus value signal WX, a stimulus value signal WY, or a stimulus value signal WZ. In an embodiment, a relationship between the subpixel W signal and each stimulus value signal corresponding to the subpixel W signal is shown in the following formula:

$$\begin{cases} WX = (\sqrt{WX}/T)^{\wedge\gamma WX} \\ WY = (\sqrt{WY}/T)^{\wedge\gamma WY} \\ WZ = (\sqrt{WZ}/T)^{\wedge\gamma WZ} \end{cases}.$$

In an embodiment, WX is the stimulus value signal WX, WY is the stimulus value signal WY, WZ is the stimulus value signal WZ, W is the subpixel W signal, and T is the maximum pixel signal value. γWX, γWY, and γWZ are all stimulus value power functions of the subpixel W signal.

Correspondingly, after the stimulus value signal of the subpixel W signal is determined, the subpixel W signal is obtained by using the following formula:

$$\begin{cases} W = WX^{\wedge(1/\gamma WX)} * 255 \\ W = WY^{\wedge(1/\gamma WY)} * 255 \\ W = WZ^{\wedge(1/\gamma WZ)} * 255 \end{cases}.$$

In an embodiment, WX is the stimulus value signal WX, WY is the stimulus value signal WY, WZ is the stimulus value signal WZ, W is the subpixel W signal, and T is the maximum pixel signal value. γWX, γWY, and γWZ are all stimulus value power functions of the subpixel W signal.

In an embodiment, the any fourth stimulus value signal is the stimulus value signal WY.

S103, a converted subpixel R signal is obtained according to a difference between any first stimulus value signal and the minimum value, obtain a converted subpixel G signal according to a difference between any second stimulus value signal and the minimum value, and a converted subpixel B signal is obtained according to a difference between any third stimulus value signal and the minimum value.

In an embodiment, for example, any first stimulus value signal is a stimulus value signal RY', and the converted subpixel R signal is shown in the following formula: $\overline{R}=(RY'-min)^{\wedge(1/\gamma RY)}*255$.

In an embodiment, $\overline{R}$ is the converted subpixel R signal, min is the minimum value, and γRX is a stimulus value power function of the initial subpixel R signal.

Similarly, the converted subpixel G signal and the converted subpixel B signal may be obtained.

S104, the converted subpixel R signal, the converted subpixel G signal, the converted subpixel B signal, and the subpixel W signal are used as converted pixel signals, where in an embodiment, the converted pixel signals are used to correspondingly drive the subpixel R, the subpixel G, the subpixel B, and a subpixel W in the particular pixel unit.

In an embodiment, the converted pixel signals include the converted subpixel R signal, the converted subpixel G signal, the converted subpixel B signal, and the subpixel W signal. Correspondingly, as shown in FIG. 2, the converted subpixel R signal drives the subpixel R, the converted subpixel G signal drives the subpixel G, the converted subpixel B signal drives the subpixel B, and the subpixel W signal drives the subpixel W.

In the pixel signal conversion method, the corresponding first stimulus value signal, second stimulus value signal, and third stimulus value signal are obtained according to the initial subpixel R signal, the initial subpixel G signal, and the initial subpixel B signal of the pixel signal. Further, the subpixel W signal is obtained by using the minimum value in the stimulus value signal set consisting of the first stimulus value signal, the second stimulus value signal, and the third stimulus value signal. The converted subpixel R signal, the converted subpixel G signal, and the converted subpixel B signal are sequentially obtained according to the minimum value. Finally, the converted subpixel R signal, the converted subpixel G signal, the converted subpixel B signal, and the subpixel W signal are used as the converted pixel signals. On this basis, when the converted pixel signals are applied to a hybrid-color display consisting of subpixels of four colors of W, R, G, and B, a display effect is closer to actual representation of original hybrid colors of R, G, and B, to alleviate a color cast defect of a large view angle and improve a display effect.

The present disclosure provides a pixel signal conversion device.

Figure 7:
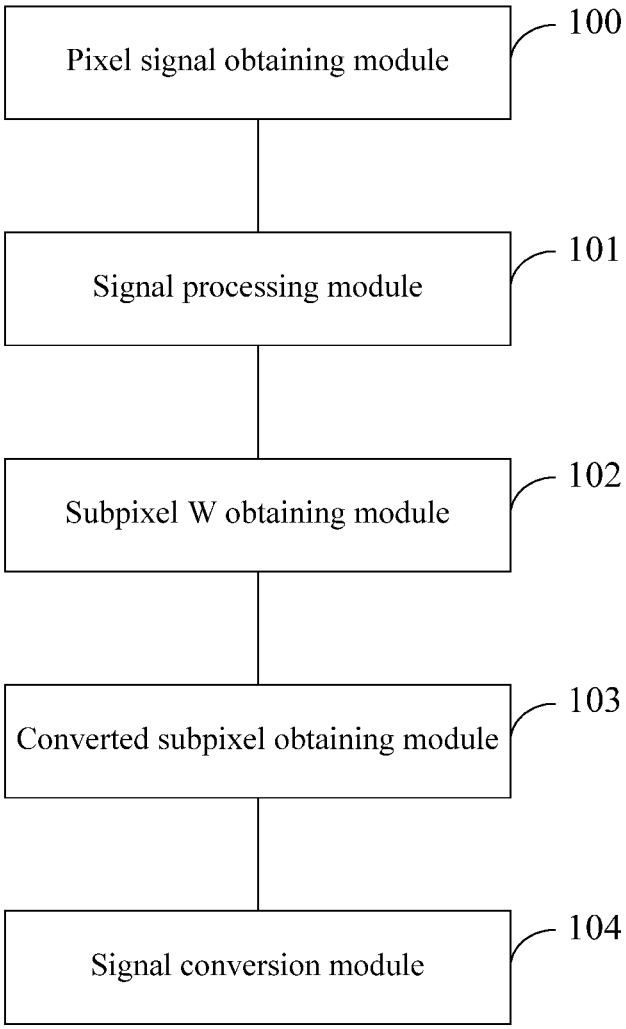
FIG. 7 is a structural diagram of modules of a pixel signal conversion device according to one or more embodiments.

FIG. 7 is a structural diagram of modules of a pixel signal conversion device according to one or more embodiments. As shown in FIG. 7, the pixel signal conversion device includes the following modules 100 to 104:

a pixel signal obtaining module 100, configured to obtain a pixel signal, where the pixel signal includes an initial subpixel R signal, an initial subpixel G signal, and an initial subpixel B signal, and in an embodiment, the pixel signal is used to correspondingly drive an subpixel R, a subpixel G, and a subpixel B in a particular pixel unit; and a signal processing module 101, configured to: obtain first stimulus value signals of the initial subpixel R signal according to the initial subpixel R signal, obtain second stimulus value signals of the initial subpixel G signal according to the initial subpixel G signal, and obtain third stimulus value signals of the initial subpixel B signal according to the initial subpixel B signal.

Figure 8:
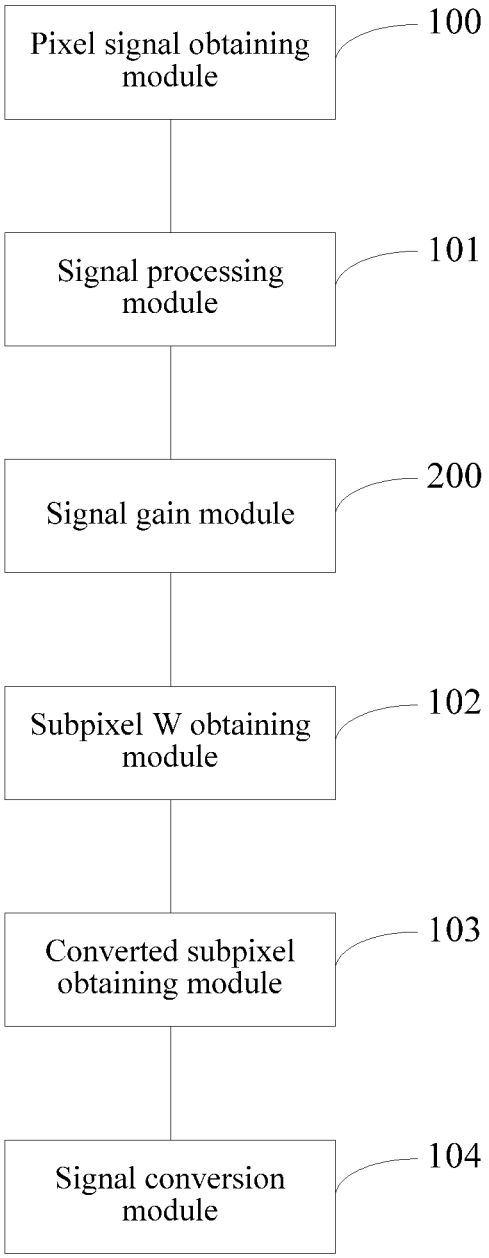
FIG. 8 is a structural diagram of modules of a pixel signal conversion device according to one or more embodiments.

In an embodiment, FIG. 8 is a structural diagram of modules of another pixel signal conversion device according to one or more embodiments. As shown in FIG. 8, the pixel signal conversion device further includes a module 200.

The signal gain module 200 is configured to separately perform gain processing on the first stimulus value signal, the second stimulus value signal, and the third stimulus value signal according to a preset gain value.

A subpixel W obtaining module 102 is configured to: obtain a subpixel W signal according to a minimum value in a stimulus value signal set, where in an embodiment, the stimulus value signal set includes a first stimulus value signal, a second stimulus value signal, and a third stimulus value signal.

In an embodiment, the subpixel W obtaining module 102 is configured to: according to a relationship between the subpixel W signal and any fourth stimulus value signal of the subpixel W signal, assign the minimum value to the any fourth stimulus value signal, to obtain the subpixel W signal.

A converted subpixel obtaining module 103 is configured to: obtain a converted subpixel R signal according to a difference between any first stimulus value signal and the minimum value, obtain a converted subpixel G signal according to a difference between any second stimulus value signal and the minimum value, and obtain a converted subpixel B signal according to a difference between any third stimulus value signal and the minimum value.

A signal conversion module 104 is configured to use the converted subpixel R signal, the converted subpixel G signal, the converted subpixel B signal, and the subpixel W signal as converted pixel signals, where in an embodiment, the converted pixel signals are used to correspondingly drive the subpixel R, the subpixel G, the subpixel B, and a subpixel W in the particular pixel unit.

The pixel signal conversion device obtains the corresponding first stimulus value signal, second stimulus value signal, and third stimulus value signal according to the initial subpixel R signal, the initial subpixel G signal, and the initial subpixel B signal of the pixel signal. Further, the subpixel W signal is obtained by using the minimum value in the stimulus value signal set consisting of the first stimulus value signal, the second stimulus value signal, and the third stimulus value signal. The converted subpixel R signal, the converted subpixel G signal, and the converted subpixel B signal are sequentially obtained according to the minimum value. Finally, the converted subpixel R signal, the converted subpixel G signal, the converted subpixel B signal, and the subpixel W signal are used as the converted pixel signals. On this basis, when the converted pixel signals are applied to a hybrid-color display consisting of subpixels of four colors of W, R, G, and B, a display effect is closer to actual representation of original hybrid colors of R, G, and B, to alleviate a color cast defect of a large view angle and improve a display effect.

In an embodiment, a computer apparatus is provided, including a memory and a processor. The memory stores a computer-readable program, which, when executed by the processor, causing the processor to perform the following steps:

obtaining a pixel signal, where the pixel signal includes an initial subpixel R signal, an initial subpixel G signal, and an initial subpixel B signal, and in an embodiment, the pixel signal is used to correspondingly drive a subpixel R, a subpixel G, and a subpixel B in a particular pixel unit;

obtaining first stimulus value signals of the initial subpixel R signal according to the initial subpixel R signal, obtaining second stimulus value signals of the initial subpixel G signal according to the initial subpixel G signal, and obtaining third stimulus value signals of the initial subpixel B signal according to the initial subpixel B signal;

obtaining a subpixel W signal according to a minimum value in a stimulus value signal set, where in an embodiment, the stimulus value signal set includes a first stimulus value signal, a second stimulus value signal, and a third stimulus value signal;

obtaining a converted subpixel R signal according to a difference between any first stimulus value signal and the minimum value, obtaining a converted subpixel G signal according to a difference between any second stimulus value signal and the minimum value, and obtaining a converted subpixel B signal according to a difference between any third stimulus value signal and the minimum value; and using the converted subpixel R signal, the converted subpixel G signal, the converted subpixel B signal, and the subpixel W signal as converted pixel signals, where in an embodiment, the converted pixel signals are used to correspondingly drive the subpixel R, the subpixel G, the subpixel B, and a subpixel W in the particular pixel unit.

The computer apparatus obtains the corresponding first stimulus value signal, second stimulus value signal, and third stimulus value signal according to the initial subpixel R signal, the initial subpixel G signal, and the initial subpixel B signal of the pixel signal. Further, the subpixel W signal is obtained by using the minimum value in the stimulus value signal set consisting of the first stimulus value signal, the second stimulus value signal, and the third stimulus value signal. The converted subpixel R signal, the converted subpixel G signal, and the converted subpixel B signal are sequentially obtained according to the minimum value. Finally, the initial subpixel R signal, the initial subpixel G signal, the initial subpixel B signal, and the subpixel W signal are used as the converted pixel signals. On this basis, when the converted pixel signals are applied to a hybrid-color display consisting of subpixels of four colors of W, R, G, and B, a display effect is closer to actual representation of original hybrid colors of R, G, and B, to alleviate a color cast defect of a large view angle and improve a display effect.

In an embodiment, a computer-readable storage medium is provided, which stores a computer program. When the computer program is executed by a processor, the following steps are performed:

obtaining a pixel signal, where the pixel signal includes an initial subpixel R signal, an initial subpixel G signal, and an initial subpixel B signal, and in an embodiment, the pixel signal is used to correspondingly drive a subpixel R, a subpixel G, and a subpixel B in a particular pixel unit;

obtaining first stimulus value signals of the initial subpixel R signal according to the initial subpixel R signal, obtaining second stimulus value signals of the initial subpixel G signal according to the initial subpixel G signal, and obtaining third stimulus value signals of the initial subpixel B signal according to the initial subpixel B signal;

obtaining a subpixel W signal according to a minimum value in a stimulus value signal set, where in an embodiment, the stimulus value signal set includes a first stimulus value signal, a second stimulus value signal, and a third stimulus value signal;

obtaining a converted subpixel R signal according to a difference between any first stimulus value signal and the minimum value, obtaining a converted subpixel G signal according to a difference between any second stimulus value signal and the minimum value, and obtaining a converted subpixel B signal according to a difference between any third stimulus value signal and the minimum value; and using the converted subpixel R signal, the converted subpixel G signal, the converted subpixel B signal, and the subpixel W signal as converted pixel signals, where in an embodiment, the converted pixel signals are used to correspondingly drive the subpixel R, the subpixel G, the subpixel B, and a subpixel W in the particular pixel unit.

In the computer-readable storage medium, the corresponding first stimulus value signal, second stimulus value signal, and third stimulus value signal are obtained according to the initial subpixel R signal, the initial subpixel G signal, and the initial subpixel B signal of the pixel signal. Further, the subpixel W signal is obtained by using the minimum value in the stimulus value signal set consisting of the first stimulus value signal, the second stimulus value signal, and the third stimulus value signal. The converted subpixel R signal, the converted subpixel G signal, and the converted subpixel B signal are sequentially obtained according to the minimum value. Finally, the converted subpixel R signal, the converted subpixel G signal, the converted subpixel B signal, and the subpixel W signal are used as the converted pixel signals. On this basis, when the converted pixel signals are applied to a hybrid-color display consisting of subpixels of four colors of W, R, G, and B, a display effect is closer to actual representation of original hybrid colors of R, G, and B, to alleviate a color cast defect of a large view angle and improve a display effect.

The technical features of the foregoing embodiments may be randomly combined. For concise description, not all possible combinations of the technical features in the foregoing embodiment are described. However, as long as a combination of the technical features has no conflict, the combination should be considered as falling within the scope of this specification.

The foregoing embodiments show only several implementations of the present disclosure, and specific descriptions thereof are provided but shall not be understood as limiting the patent scope of the present disclosure. It should be pointed out that a person of ordinary skill in the art may further make several variations and improvements without departing from the idea of the present disclosure, and the variations and improvements belong to the protection scope of the present disclosure. Therefore, the patent protection scope of the present disclosure shall be subject to the appended claims.

What is claimed is:

1. A pixel signal conversion method, comprising the following steps of:

obtaining a pixel signal, wherein the pixel signal comprises an initial subpixel R signal, an initial subpixel G signal, and an initial subpixel B signal, wherein the pixel signal is configured to correspondingly drive a subpixel R, a subpixel G, and a subpixel B in a particular pixel unit;

obtaining first stimulus value signals of the initial subpixel R signal according to the initial subpixel R signal, obtaining second stimulus value signals of the initial subpixel G signal according to the initial subpixel G signal, and obtaining third stimulus value signals of the initial subpixel B signal according to the initial subpixel B signal;

obtaining a subpixel W signal according to a minimum value in a stimulus value signal set, wherein the stimulus value signal set comprises a first stimulus value signal, a second stimulus value signal, and a third stimulus value signal;

obtaining a converted subpixel R signal according to a difference between any first stimulus value signal and the minimum value, obtaining a converted subpixel G signal according to a difference between any second stimulus value signal and the minimum value, and obtaining a converted subpixel B signal according to a difference between any third stimulus value signal and the minimum value; and using the converted subpixel R signal, the converted subpixel G signal, the converted subpixel B signal, and the subpixel W signal as converted pixel signals, wherein the converted pixel signals are configured to correspondingly drive the subpixel R, the subpixel G, the subpixel B, and a subpixel W in the particular pixel unit, wherein the first stimulus value signal is a stimulus value signal RX, a stimulus value signal RY, or a stimulus value signal RZ;

the second stimulus value signal is a stimulus value signal GX, a stimulus value signal GY, or a stimulus value signal GZ; and the third stimulus value signal is a stimulus value signal BX, a stimulus value signal BY, or a stimulus value signal BZ, wherein a process of obtaining first stimulus value signals of the initial subpixel R signal according to the initial subpixel R signal is represented by the following formula:

$$\begin{cases} RX = (R/T)^{\wedge\gamma RX} \\ RY = (R/T)^{\wedge\gamma RY} \\ RZ = (R/T)^{\wedge\gamma RZ} \end{cases};$$

a process of obtaining second stimulus value signals of the initial subpixel G signal according to the initial subpixel G signal is represented by the following formula:

$$\begin{cases} GX = (G/T)^{\wedge\gamma GX} \\ GY = (G/T)^{\wedge\gamma GY} \\ GZ = (G/T)^{\wedge\gamma GZ} \end{cases};$$

and a process of obtaining third stimulus value signals of the initial subpixel B signal according to the initial subpixel B signal is represented by the following formula:

$$\begin{cases} BX = (B/T)^{\wedge\gamma BX} \\ BY = (B/T)^{\wedge\gamma BY} \\ BZ = (B/T)^{\wedge\gamma BZ} \end{cases},$$

wherein RX is the stimulus value signal RX, RY is the stimulus value signal RY, RZ is the stimulus value signal RZ, and R is the initial subpixel R signal; GX is the stimulus value signal GX, GY is the stimulus value signal GY, GZ is the stimulus value signal GZ, and G is the initial subpixel G signal; BX is the stimulus value signal BX, BY is the stimulus value signal BY, BZ is the stimulus value signal BZ, and B is the initial subpixel B signal; and T is a maximum pixel signal value; and $\gamma^{RX}$, $\gamma^{RY}$, and $\gamma^{YRZ}$are stimulus value power functions of the initial subpixel R signal;

$\gamma^{GX}$, $\gamma^{GY}$, and $y^{GZ}$and are stimulus value power functions of the initial subpixel G signal; and $\gamma^{BX}$, $\gamma^{BY}$, and $\gamma^{BZ}$are stimulus value power functions of the initial subpixel B signal.

2. A computer apparatus, comprising a processor and a memory storing computer-readable programs, which, when executed by the processor, causing the processor to perform steps comprising:

obtaining a pixel signal, wherein the pixel signal comprises an initial subpixel R signal, an initial subpixel G signal, and an initial subpixel B signal, and the pixel signal is configured to correspondingly drive a subpixel R, a subpixel G, and a subpixel B in a particular pixel unit;

obtaining first stimulus value signals of the initial subpixel R signal according to the initial subpixel R signal, obtaining second stimulus value signals of the initial subpixel G signal according to the initial subpixel G signal, and obtaining third stimulus value signals of the initial subpixel B signal according to the initial subpixel B signal;

obtaining a subpixel W signal according to a minimum value in a stimulus value signal set, wherein the stimulus value signal set comprises a first stimulus value signal, a second stimulus value signal, and a third stimulus value signal;

obtaining a converted subpixel R signal according to a difference between any first stimulus value signal and the minimum value, obtaining a converted subpixel G signal according to a difference between any second stimulus value signal and the minimum value, and obtaining a converted subpixel B signal according to a difference between any third stimulus value signal and the minimum value; and using the converted subpixel R signal, the converted subpixel G signal, the converted subpixel B signal, and the subpixel W signal as converted pixel signals, wherein the converted pixel signals are configured to correspondingly drive the subpixel R, the subpixel G, the subpixel B, and a subpixel W in the particular pixel unit, wherein the first stimulus value signal is a stimulus value signal RX, a stimulus value signal RY, or a stimulus value signal RZ;

the second stimulus value signal is a stimulus value signal GX, a stimulus value signal GY, or a stimulus value signal GZ; and the third stimulus value signal is a stimulus value signal BX, a stimulus value signal BY, or a stimulus value signal BZ, wherein a process of obtaining first stimulus value signals of the initial subpixel R signal according to the initial subpixel R signal is represented by the following formula:

$$\begin{cases} RX = (R/T)^{\wedge\gamma RX} \\ RY = (R/T)^{\wedge\gamma RY} \\ RZ = (R/T)^{\wedge\gamma RZ} \end{cases};$$

a process of obtaining second stimulus value signals of the initial subpixel G signal according to the initial subpixel G signal is represented by the following formula:

$$\begin{cases} GX = (G/T)^{\wedge\gamma GX} \\ GY = (G/T)^{\wedge\gamma GY} \\ GZ = (G/T)^{\wedge\gamma GZ} \end{cases};$$

and a process of obtaining third stimulus value signals of the initial subpixel B signal according to the initial subpixel B signal is represented by the following formula:

$$\begin{cases} BX = (B/T)^{\wedge\gamma BX} \\ BY = (B/T)^{\wedge\gamma BY} \\ BZ = (B/T)^{\wedge\gamma BZ} \end{cases},$$

wherein RX is the stimulus value signal RX, RY is the stimulus value signal RY, RZ is the stimulus value signal RZ, and R is the initial subpixel R signal; GX is the stimulus value signal GX, GY is the stimulus value signal GY, GZ is the stimulus value signal GZ, and G is the initial subpixel G signal; BX is the stimulus value signal BX, BY is the stimulus value signal BY, BZ is the stimulus value signal BZ, and B is the initial subpixel B signal; and T is a maximum pixel signal value; and $\gamma^{RX}$, $\gamma^{RY}$, $\gamma^{RZ}$are stimulus value power functions of the initial subpixel R signal;

$\gamma^{GX}$, $\gamma^{GY}$, and $\gamma^{RZ}$are stimulus value power functions of the initial subpixel G signal; and $\gamma^{BX}$, $\gamma^{BY}$, and $\gamma^{BZ}$are stimulus value power functions of the initial subpixel B signal.

3. The computer apparatus according to claim 2, prior to a process of obtaining the subpixel W signal according to the minimum value in the stimulus value signal set, further comprising the following step of:

performing gain processing on the first stimulus value signal, the second stimulus value signal, and the third stimulus value signal, respectively according to a preset gain value.

4. The computer apparatus according to claim 2, wherein a process of obtaining the subpixel W signal according to a minimum value in a stimulus value signal set comprises the following step of:

assigning the minimum value to the any fourth stimulus value signal according to a relationship between the subpixel W signal and any fourth stimulus value signal of the subpixel W signal, to obtain the subpixel W signal.

5. The computer apparatus according to claim 4, wherein the fourth stimulus value signal is a stimulus value signal WX, a stimulus value signal WY, or a stimulus value signal WZ; and the any fourth stimulus value signal is the stimulus value signal WY.

6. The pixel signal conversion method according to claim 1, wherein prior to a process of obtaining the subpixel W signal according to the minimum value in the stimulus value signal set, the method further comprises the following step of:

performing gain processing on the first stimulus value signal, the second stimulus value signal, and the third stimulus value signal, respectively according to a preset gain value.

7. The pixel signal conversion method according to claim 1, wherein a process of obtaining the subpixel W signal according to a minimum value in a stimulus value signal set comprises the following step:

assigning the minimum value to the any fourth stimulus value signal according to a relationship between the subpixel W signal and any fourth stimulus value signal of the subpixel W signal, to obtain the subpixel W signal.

8. The pixel signal conversion method according to claim 7, wherein the fourth stimulus value signal is a stimulus value signal WX, a stimulus value signal WY, or a stimulus value signal WZ; and the any fourth stimulus value signal is the stimulus value signal WY.

9. The pixel signal conversion method according to claim 1, wherein the stimulus value signal set comprises the stimulus value signal RY, the stimulus value signal GY, and the stimulus value signal BY.

10. The pixel signal conversion method according to claim 1, wherein the stimulus value signal set comprises the stimulus value signal RX, the stimulus value signal GY, and the stimulus value signal BZ.

* * * * *